US006967903B2

(12) United States Patent
Guanter

(10) Patent No.: US 6,967,903 B2
(45) Date of Patent: Nov. 22, 2005

(54) CONTROL METHOD FOR EXECUTING FUNCTIONS IN A DIARY WATCH

(75) Inventor: Jean-Charles Guanter, Diesse (CH)

(73) Assignee: Asulab S.A., Marin (CH)

( * ) Notice: Subject to any disclaimer, the term of this patent is extended or adjusted under 35 U.S.C. 154(b) by 124 days.

(21) Appl. No.: 10/329,561

(22) Filed: Dec. 27, 2002

(65) Prior Publication Data

US 2003/0123328 A1 Jul. 3, 2003

(30) Foreign Application Priority Data

Dec. 27, 2001 (CH) ..... 2374/01

(51) Int. Cl.[7] ..... G04C 17/00
(52) U.S. Cl. ..... 368/224; 368/232; 368/242
(58) Field of Search ..... 368/69, 224, 76, 368/80, 223, 228, 230, 232, 238, 242

(56) References Cited

U.S. PATENT DOCUMENTS

| | | | | |
|---|---|---|---|---|
| 3,983,690 A | * | 10/1976 | McClintock | 368/69 |
| 4,139,837 A | * | 2/1979 | Liljenwall et al. | 382/189 |
| 4,162,610 A | | 7/1979 | Levine | |
| 4,228,534 A | * | 10/1980 | Fellrath et al. | 368/224 |
| 4,257,117 A | * | 3/1981 | Besson | 368/69 |
| 4,369,440 A | | 1/1983 | Piguet et al. | |
| 4,385,291 A | * | 5/1983 | Piguet | 345/173 |
| 5,012,124 A | * | 4/1991 | Hollaway | 307/116 |
| 5,088,070 A | | 2/1992 | Shiff | |
| 5,329,501 A | | 7/1994 | Meister et al. | |
| 5,453,960 A | * | 9/1995 | Teres et al. | 368/69 |
| 5,528,559 A | | 6/1996 | Lucas | |
| 5,742,564 A | * | 4/1998 | Kuschel et al. | 368/69 |
| 5,940,349 A | * | 8/1999 | Stewart | 368/69 |
| 6,728,166 B2 | * | 4/2004 | Grupp | 368/69 |
| 2002/0118605 A1 | * | 8/2002 | Born et al. | 368/69 |

FOREIGN PATENT DOCUMENTS

EP 1 079 325 A1 2/2001

* cited by examiner

*Primary Examiner*—Kamand Cuneo
*Assistant Examiner*—Jeanne-Marguerite Goodwin
(74) *Attorney, Agent, or Firm*—Sughrue Mion, PLLC

(57) ABSTRACT

The control method allows execution of various functions in an electronic diary watch, which includes, in a case closed by a crystal, a time-keeping circuit and/or a watch movement powered by an energy source, and a dial on which the time is displayed in a digital and/or analogue manner. A determined number of sensors (C1 to C7) are provided with touch sensitive pads arranged on an inner or outer face of the crystal. These sensors are provided for carrying out the various controls of the method when they are individually activated by a user's finger. In order to consult data or parameters, the method includes a first series of steps consisting in displaying different menus (102 to 106) of the diary function on at least one liquid crystal display by activating at least one sensor (C4, C5) of a group of sensors (C4 to C7), and in selecting the menu or record to be consulted (107 to 111) by activating a validation sensor (C1). In order to enter data, the method includes a second series of steps consisting in activating the validation sensor (C1) for a determined period of time or with a determined application of pressure, entering diary data by activating certain sensors (C2 to C7) each controlling execution of a specific determined function, and validating data entered by action on the validation sensor.

16 Claims, 8 Drawing Sheets

CONTROL METHOD FOR EXECUTING FUNCTIONS IN A DIARY WATCH

BACKGROUND OF THE INVENTION

The invention concerns a control method for executing functions in a diary watch. Via this method, it is possible, in particular, to carry out the control for consulting and selecting different diary function menus and for displaying stored or edited data or setting parameters.

In order to do this, an electronic diary watch is used for implementing the method. This watch includes, in a case closed by a crystal, a time-keeping circuit and/or a watch movement powered by an energy source, a dial on which the time is displayed in a digital and/or analogue manner, and at least one liquid crystal display for displaying diary data. Sensor touch sensitive pads are arranged on an internal or external face of the watch crystal for controlling multiple operations of the method. These sensors can each be activated by a user's finger placed on the crystal close to the sensitive pad of the sensor to be activated. A microprocessor unit of the watch is programmed to manage the diary function operations. This unit can also include certain modules connected to the time base. Thus, it is possible to consult different menus or stored data, or to enter, modify or delete data and/or parameters by means of the sensors connected to the unit.

Execution of the watch functions concerns for example data or parameters entry, particularly for composing notes, addresses for an address book, for diary meetings, or for setting the time and the date. Moreover, it may also concern functions for modifying or deleting stored data, for consulting various menus or stored data, time slots to be programmed, alarms or wireless data transmission.

A method for entering data into a wristwatch by means of touch sensitive sensors has already been disclosed particularly in Swiss Patent No. 635 975. In this document, the control means for the watch and diary functions consist of a push-button located on the middle part of the watch and a keyboard comprising only three keys formed on the crystal by touch sensitive sensors of the capacitive type. These three keys first of all allow function selection for reading stored dates and messages, storing or correcting dates and messages, and correcting the time indication.

After selecting a function, complex manipulations have to be made on the three keys and the push-button in order to be able to use said function, which is a drawback. For example, in storage mode, the choice of a letter of the alphabet for writing a message that must include no more than 9 letters is achieved by successive selections in groups of letters. This requires three manipulations of the touch sensors and a last application of pressure on the push-button as well as a good memory of the place of the letters in the alphabet. It thus appears that the design of the keyboard with a reduced number of touch sensors has an advantage as regards aesthetic appearance. However, it has the drawback of making such a diary-watch very complicated to use, while only offering relatively limited possibilities. For example, at least one additional manipulation has to be made to be able to have more than 27 characters, such as upper or lower case letters.

SUMMARY OF THE INVENTION

It is also to be noted that during composition of a text or message, the push-button also has to be used which complicates manipulations for the watch and diary functions. It is not possible with this reduced number of sensors and the push-button to enter a large amount of data easily for different records of different menus that such a diary watch should include.

The main object of the invention is thus to overcome the drawbacks of the prior art by proposing a control method for executing functions in a diary watch facilitating consultation of different menus or menu data and the entry, modification or deletion of data and/or parameters. The position of the sensors on the watch crystal has to allow the diary function data to be read or entered quickly and intuitively.

The invention therefore concerns a control method for executing functions in an electronic diary watch, cited hereinbefore, which is characterised in that it includes a first series of steps, in a first diary function consultation mode, of:

- displaying different menus or parameters or data or data records of a diary function menu on the liquid crystal display in ascending or descending order by activating at least one sensor of a group of sensors each able to carry out a same function in this first mode, and
- selecting a menu or data record, of a type from among several types, of the menu to be consulted by activating a validation sensor, and in that the method includes a second series of steps, in a second data and/or parameter entry, modification or deletion mode, of:

- activating the validation sensor for a determined period of time or with a determined application of pressure in order to enter the second mode in a desired position of a selected menu,
- entering, modifying or deleting data and/or parameters by activating certain sensors each controlling execution of a specific determined function in this second mode, and
- validating the parameters and/or the data entered, modified or deleted by action on the validation sensor.

The invention thus also concerns a control method for executing functions in an electronic diary watch, characterised in that it includes a series of steps, in a diary function data and/or parameter entry, modification or deletion mode, of:

- activating a validation sensor for a determined period of time or with a determined application of pressure in order to enter the data and/or parameter entry, modification or deletion mode in a desired position of a determined menu, and
- entering, modifying or deleting data and/or parameters by activating certain sensors each controlling execution of a specific determined function in this mode, and
- validating the parameters and/or the data entered, modified or deleted by action on the validation sensor.

One advantage of the control method for executing functions, according to the invention, is that it is possible to control quickly and intuitively a data consultation or entry mode using a reduced number of sensors. This number of sensors is, for example less than 10, preferably equal to 7. The transparent sensitive pads of the sensors are arranged on the internal or external face of the watch crystal, which has the advantage of not adversely affecting the aesthetic appearance of the watch.

In order to allow a user to control execution of functions easily and intuitively, the sensitive pads are distributed on the crystal at a sufficient distance from each other. Thus, it is possible to place a finger on a sensitive pad of a single sensor without influencing other neighbouring sensors. The circular shaped sensitive pads can be separated by a distance greater than or equal to the diameter of each electrode.

If the analogue watch includes seven sensors one of which is at the centre of the crystal, two sensors can be positioned preferably at the periphery around the 3 o'clock indication. Two other sensors can be positioned preferably at the periphery around the 9 o'clock indication. Finally, two other sensors can be placed at the periphery respectively on the 6 o'clock and 12 o'clock indications. Thus, it is possible to display all the data displayed on the liquid crystal display(s) during activation of the sensitive pads, located at the periphery of the crystal, by a user's finger.

In a menu or data or menu data record consultation mode, the sensors located around the 3 o'clock and 9 o'clock indications are used to go through the data in ascending or descending order. By activating one of the sensors around the 3 o'clock indication, the menus or data scroll on the liquid crystal display(s) in ascending order. By activating one of the sensors around the 9 o'clock indication the menus or data scroll on the liquid crystal display(s) in descending order. Thus, only two groups of sensors are active in this consultation mode for displaying all the menus or data of the selected menu. Selection of a menu is achieved easily by activating the sensor located at the centre of the crystal.

Another advantage of the control method according to the invention is that in order to enter into a data entry, modification or deletion mode, the validation sensor located at the centre of the crystal has to be activated for a determined period of time or with a determined application of pressure in a desired position of a selected menu. In this data entry, modification or deletion mode, the six sensors around the validation sensor at the centre of the crystal are each configured to execute a specific function. For example, the sensors above the 3 o'clock and 9 o'clock indications allow a set of characters (upper case letters, lower case letters, numbers, symbols or accents) to be selected in one direction or the other. The sensors located below the 3 o'clock and 9 o'clock indications allow a cursor to be moved in the edited or modified text in one direction or the other. Finally, the sensors located on the 6 o'clock and 12 o'clock indications allow the characters of a selected set to scroll in ascending or descending order.

In this editing mode, another advantage of the method according to the invention is that the speed at which the characters successively appearing on one of the liquid crystal displays scroll can be adapted as a function of the duration or activation pressure of the sensors located on the 6 o'clock and 12 o'clock indications.

Moreover, markings can be provided on the internal face of the crystal to indicate to the user the position of each transparent sensitive sensor pad, and to represent a specific function of each sensor. The sensors can be of the capacitive or resistive type.

With the diary watch control method, it is possible to complete for example record fields of notes, addresses of an address book, a diary. A field can include for example up to 63 alphanumerical characters, whereas a record can include several fields. Consequently, with the seven sensors available, it is easy to introduce a significant number of fields to be stored for each type of record. The memory of the microprocessor unit can store for example 1920 note records, or 2100 diary records, or 333 address records with completed fields of a mean number of 12 characters.

In order to prevent accidental activation of the sensors, the middle part of the case preferably includes a push-button that allows the sensors and liquid crystal displays of the diary function to be activated. The sensors and the liquid crystal displays are placed initially and/or after a period of inactivity in a standby mode in order to reduce energy consumption when the diary function is not desired or being used. The push-button can also be used to reinitialise the diary function.

BRIEF DESCRIPTION OF THE DRAWINGS

The objects, advantages and features of the control method for executing functions in an electronic diary watch will appear more clearly in the following description with reference to the drawings, in which.

DETAILED DESCRIPTION OF THE INVENTION

Figure 1:
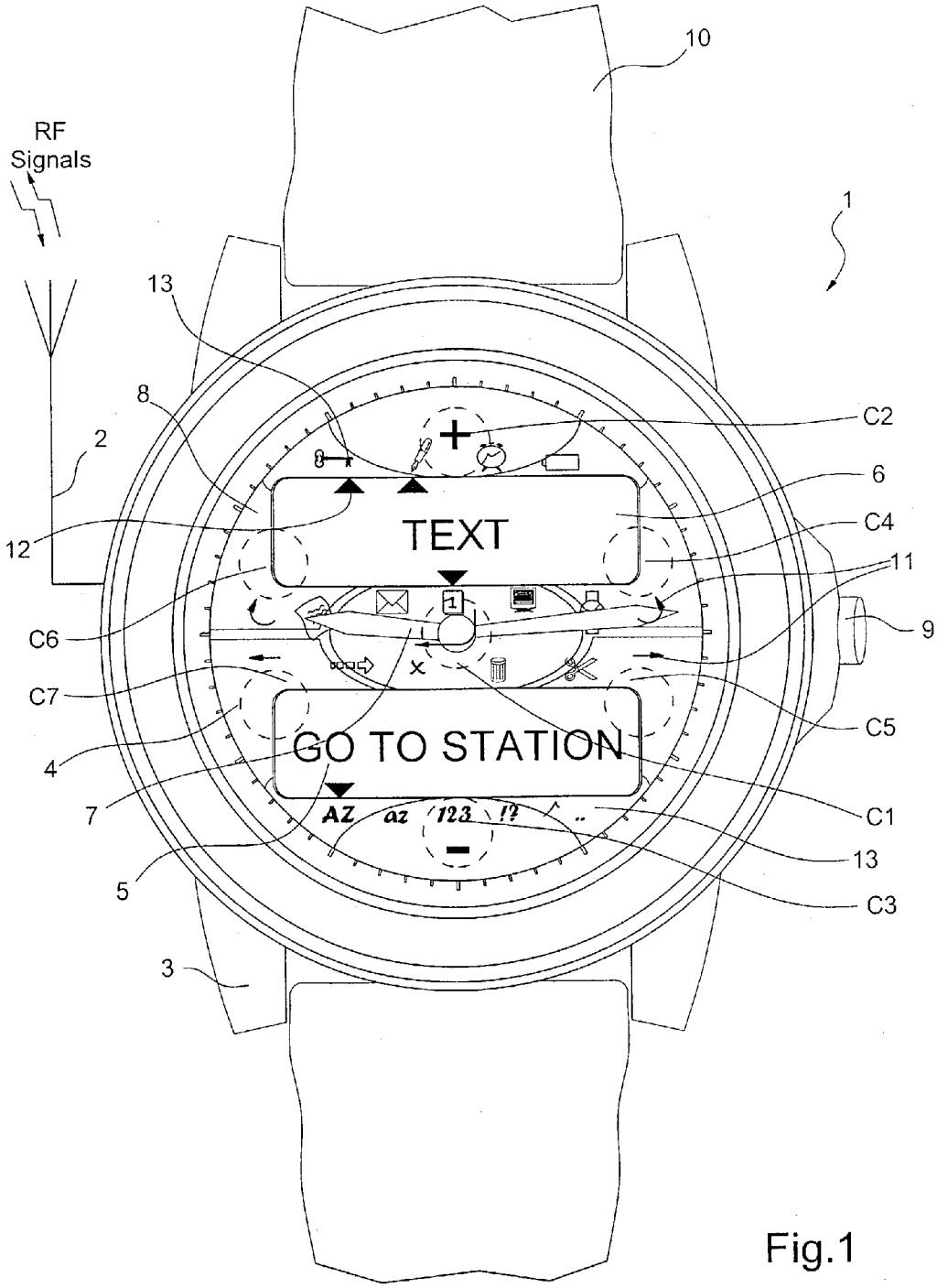
FIG. 1 shows a top view of an electronic analogue time display watch provided for implementing the method according to the invention.
Figure 2:
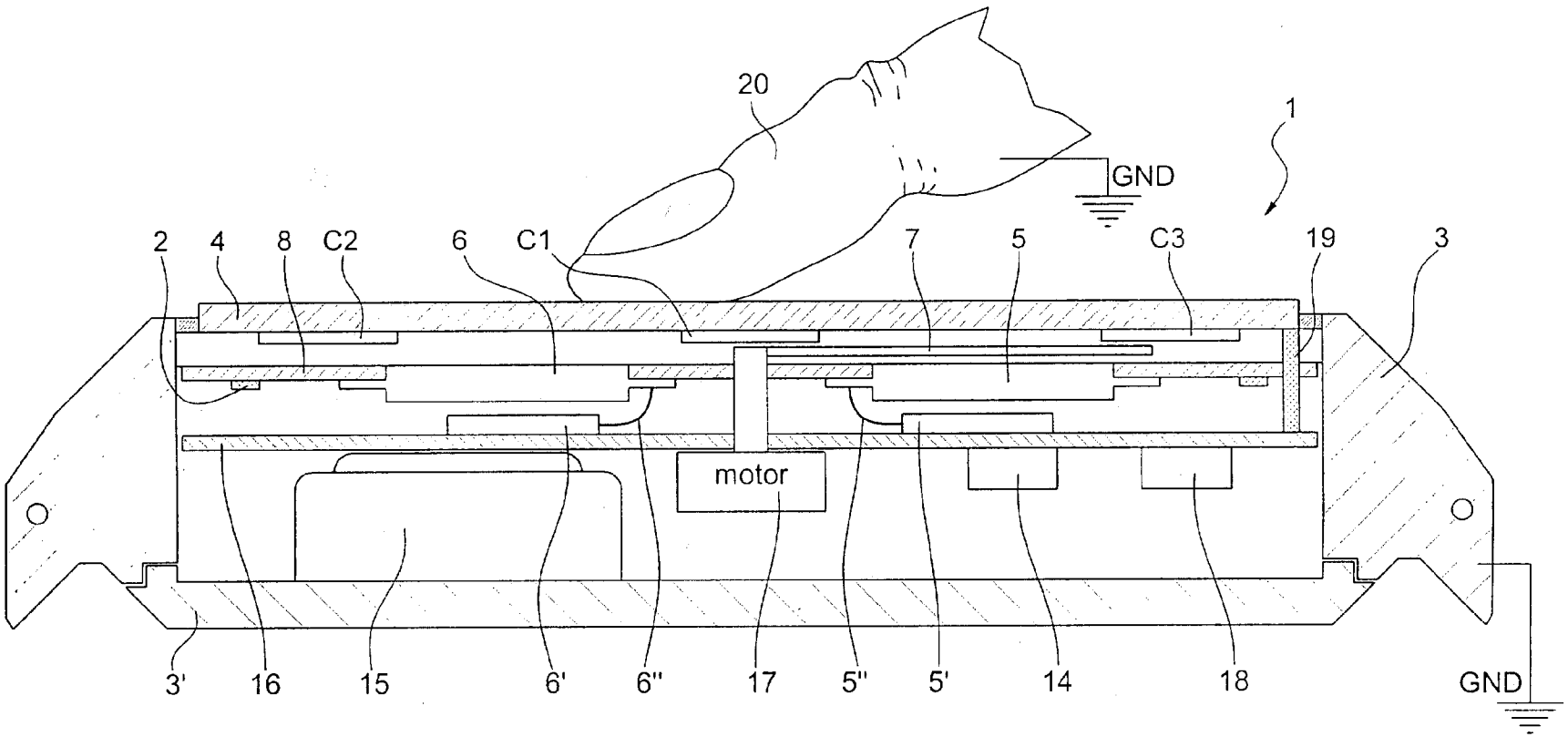
FIG. 2 shows a cross-section along the 6 o'clock-12 o'clock line of the watch shown in FIG. 1.

In the example shown in FIGS. 1 and 2, diary watch 1, for implementing the method forming the subject of the invention, is of the type with a wristband 10 with analogue time display. It includes, in a known manner, a case, delimited by a middle part 3 having a bezel integral therewith and a back cover 3', a dial 8 with two liquid crystal displays 5 and 6 of the matrix type, hands 7 for indicating the time, a push-button 9 and a crystal 4 closing the case. The crystal can be a scratchproof sapphire glass. The case contains under dial 8 an electronic watch movement 17 powered by an energy source 15, such as a battery or an accumulator, for driving hour and minute hands 7. The energy source can be formed for example of two 1.55 volt silver oxide batteries such as the RENATA 350 battery sold by RENATA AG, Switzerland.

The two liquid crystal displays 5 and 6 are preferably of equal dimensions located on either side of the shaft carrying the hands. These displays 5 and 6 are for example secured to the back of dial 8 and appear in two openings in dial 8. The two displays are mainly used for the diary function in order to display, in a perpendicular direction to the length of wristband 10, different menus to be consulted and edited and stored data.

Diary watch 1 further includes, under dial 8, a printed circuit board 16, which supports watch movement 17. Two display drive devices 5' and 6' are mounted on this board, which are each connected by a flexible strip of conductive paths 5" and 6" to each display 5 and 6, and a microprocessor unit 14 programmed to manage the diary function. In the embodiment shown in FIG. 2, the positive pole of battery 15 or the accumulator is connected to a positive supply terminal of printed circuit board 16, whereas the negative pole GND of battery 15 is connected to back cover 3' of the metal case. However, one could envisage connecting the positive pole of the battery to the supply terminal of board 16, and the positive pole to back cover 3' of the case.

For various manipulations of the diary function that will be explained in detail with reference to FIGS. 3 to 8, diary watch 1 includes a determined number of sensors C1 to C7 preferably of the capacitive type. The sensitive pads of the sensors, which are very thin transparent conductive layers, are arranged on an inner face of crystal 4. The sensitive pads of the sensors are connected to microprocessor unit 14 via transparent conductive wires that are not shown on the inner face of the crystal and a connector 19. The number of sensitive pads is preferably equal to seven for the diary function controls.

The touch sensitive pads are represented in FIG. 1 by circles in dotted lines. All of circular shaped sensitive pads C1 to C7 can be separated by a distance greater than or equal to the diameter of each pad. Thus, a user's finger 20 can be placed on crystal 4 in a determined zone of a sensitive pad of a single sensor to be activated without influencing the other neighbouring sensors. Moreover, markings 11 are placed on the inner face of crystal 4 so as to indicate the position of each sensitive pad, as well as a function for each sensor C1 to C7.

One sensitive pad of a sensor C1 is placed at the centre of crystal 4. This validation sensor C1 is used in particular for selecting various menus or various data records of a selected menu appearing on displays 5, 6. Further, this validation sensor is used to validate the entry of data in an editing mode for various diary function records. When a user's finger activates this sensor C1 for a determined period of time, for example greater than 2 seconds, the data and/or parameter entry, modification or deletion mode is operative in a desired position of the selected menu. One may also envisage entering this mode by activating sensor C1 by an application of pressure greater than a determined threshold programmed in microprocessor unit 14.

The desired position in the selected menu can be for example relative to data and/or parameters, or to records of different types (notes, addresses, diary) placed at the first level of the selected menu or to other data of the selected menu.

Two second sensors C2, C3 have their sensitive pad arranged at the periphery of the crystal, respectively at 12 o'clock and 6 o'clock. These sensors C2, C3 can be used in an editing mode for scrolling in ascending or descending order the alphanumerical characters, symbols, punctuation marks or accents. By keeping the finger on one or other of sensors C2, C3, the characters can be scrolled in one direction or the other at a higher speed in order to find the desired character quickly. In an alternative embodiment, a greater application of pressure on one or other of sensors C2 or C3 can increase the scrolling speed.

The management of the scrolling speed of the characters of a selected set of characters can be carried out by microprocessor unit 14. For the sake of simplification, there may be provided a first slow speed when the duration of activations of sensor C2 or sensor C3 is below a determined threshold value. A second fast character scrolling speed is achieved if the duration of activation of sensor C2 or sensor C3 is greater than a determined threshold value.

In order to validate, for example, the desired character, sensor C1 can be activated by the user's finger. If the diary menu has been selected, sensors C2, C3 are used to scroll the months of the calendar in an ascending or descending order. If the address menu has been selected, they are used to scroll the first name under each letter of the alphabet in ascending order with sensor C2 and in descending order with sensor C3.

It is to be noted that when a menu is selected from the diary function (notes, addresses, diary, transmission, settings), second sensors C2 and C3 do not provide any control.

Two third sensors C4, C5 have their sensitive pad arranged at the periphery of the crystal around the 3 o'clock indication. Finally, two fourth sensors C6, C7 have their sensitive pad arranged at the periphery of the crystal around the 9 o'clock indication. Sensors C4, C5 are used to display various menus successively on displays 5 and 6 in a determined ascending order, whereas sensors C6, C7 are used to display the menus in a determined descending order. By pressing on sensor C1, the desired menu is selected, and sensors C4 to C7 can be activated in order to consult the data and/or parameters, or the data records of the selected menu. If the diary menu has been selected, sensors C4 to C7 are used to scroll the days of the month of the calendar in ascending order with sensors C4, C5 or in descending order with sensors C6, C7. If the address menu has been selected sensors C4 to C7 are used to scroll the names in the address book in ascending order with sensors C4, C5 or in descending order with sensors C6, C7. In an editing mode, sensors C4 to C7 allow a set of characters to be selected for editing a note, an address or appointment/meeting in the diary, and also to move a cursor in the edited message.

This distribution of characters on glass or crystal 4 allows various instructions of the diary function to be executed easily and intuitively without it being necessary to consult a specific operation guidance.

In microprocessor unit 14, a non-volatile memory, for example of the EEPROM type, not shown, is used to store all the data records entered using touch sensitive sensors. The microprocessor of said unit can be for example the 8-bit PUNCH microprocessor manufactured by EM Microelectronic-Marin SA in Switzerland.

Short distance radio-frequency signal transmission and/or receiving means are also provided in diary watch 1. They include an RF module 18 fixed to printed circuit board 16, and an antenna 2 connected by a connector 19 to RF module 18. A communication can be established for example with a computer station or another watch that is not shown for two-directional transmission of diary data signals. Since the case of the watch is made of metallic material in this embodiment, antenna 2 is preferably placed under dial 8 at its periphery. For transmission in the ISN band at 433.9 MHz for example, the antenna is formed of a single circular turn. This turn defines a portion of a circle with the largest possible diameter in order to have the maximum possible gain in the given space of the watch. However, the antenna can be of larger dimensions and adapted to the selected frequency of the radio-frequency signals. This carrier frequency can be selected up to a frequency of the order of 2.45 GHz for example.

Icons 13 are placed on watch dial 8 around each liquid crystal display to represent a menu, an operation or programming to be carried out. At least one pointer 12 appearing on at least one of displays 5 and 6 is controlled by microprocessor unit 14 to designate one of the icons. Thus, the user can directly observe which operation, which menu or which programming is being carried out or selected. The icons can define for example data confidentiality, editing mode, alarms, the state of the battery, note, address, diary, transmission and setting menus, operations for editing, cancelling data entry, data deletion, or character insertion or deletion, sets of characters (upper case letters, lower case letters, numbers, symbols or accents). In FIG. 1, three pointers of display 6 indicate data confidentiality, editing mode and the selected diary menu, whereas a pointer of display 5 indicates the set of characters selected by sensors C4 or C6 for writing a text.

In order to reduce the consumption of the energy source, sensors C1 to C7 are in a rest or standby mode when the diary function is not activated, as well as liquid crystal displays 5, 6 and part of microprocessor unit 14. In this standby mode, the diary watch only supplies time related information, and the sensors remain inactive.

Push-button 9 located on middle part 3 allows the diary function to be switched-on or reinitialised. In this operating mode, hands 7 are driven by motor 17 so as to occupy a position that does not disturb the display of data on each display, as well as the operation of each sensor. A first hand can occupy a position close to the 9 o'clock indication, whereas a second hand can occupy a position close to the 3 o'clock position. Once the diary function is no longer being used, for example after a determined period of inactivity, it is deactivated. From this moment on, hands 7 are returned to their time indicating position in a manner well known to those skilled in the art in this technical field.

It should be noted that one could envisage switching on the diary function by action on at least one of sensors C1 to C7 for a determined period of time. However, in a particularly damp atmosphere, the sensors are likely to be continually activated by the presence of water on crystal 4 of watch 1. Consequently, wasteful energy consumption is likely to run down the watch battery or accumulator more quickly.

The electronic diary watch can be compared to a conventional PDA type organiser. However, the reduced number of easily to manipulate sensors offers a considerable advantage with respect to such an organiser, without detracting from the aesthetic appearance of the diary watch. By way of example, it is possible to compose and store in the microprocessor unit memory 1920 note records, or 2100 diary records, or 333 address records with completed fields with a mean of 12 characters. For different types of records, the memory can store for example 100 note records, 1000 diary records and 160 address records which is considerable for such a diary watch.

It is of course clear that the capacitive sensors of the diary watch can be configured in a different way, particularly by microprocessor unit 14 for the execution of other functions that are not described. Moreover, the sensors can also be of the resistive type with their sensitive pad arranged on the outer face of the crystal, but with isolated connection wires to the microprocessor unit. However, these pads are likely to wear out quickly following multiple contacts with a user's finger on the crystal.

For complementary technical details concerning the processing of signals for activating the sensors, the reader can refer to European Patent document No. EP 0 838 737 by the same Applicant which is cited by way of reference.

The different steps of the control method according to the invention will now be described with reference to FIGS. 3 to 8.

Figure 3:
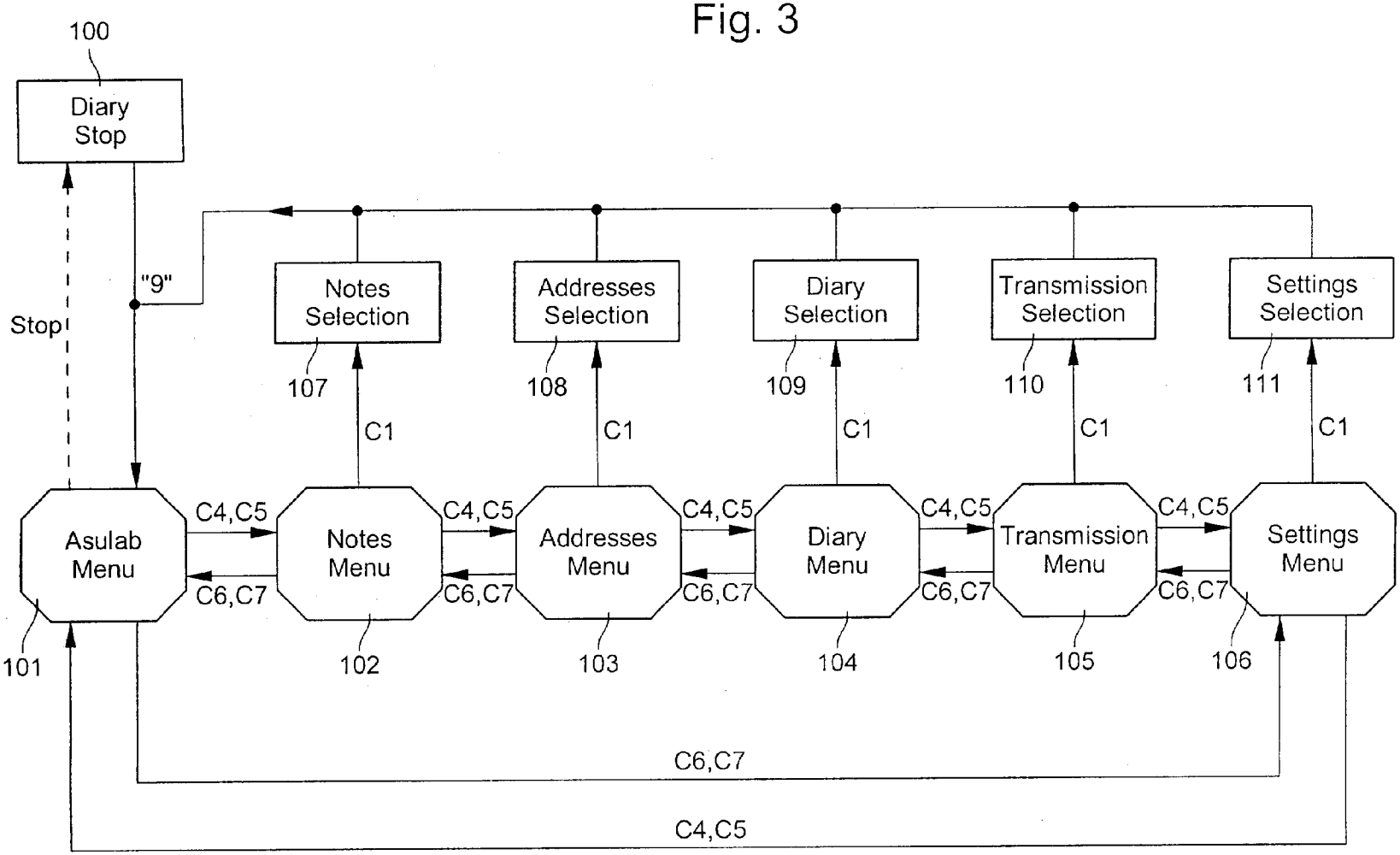
FIG. 3 shows a flow chart of steps of the method, according to the invention, for displaying and selecting different menus of the diary function.

FIG. 3 shows a first series of steps of the control method according to the invention. In this first series of steps, the various menus are displayed on the liquid crystal displays when the diary function is in operation via action on push-button 9.

In a standby mode at step 100, the sensors are in an inactive state, and the liquid crystal displays do not display any data. As soon as pressure is applied on push-button 9 at step 101, the initial Asulab menu is shown on the liquid crystal displays. Preferably, the liquid crystal display placed above the 3 o'clock and 9 o'clock indications displays "Menu", whereas the liquid crystal display placed below the 3 o'clock and 9 o'clock indications displays "Asulab". It is of course clear that a single display could also be used in the diary watch and display this data for example on one or more lines.

In the following description, it should be noted that the frames which are cut in the corners of each flow chart of FIGS. 3 to 8, and which contain various data, show an example of what can be displayed on the liquid crystal displays. For the sake of simplification, reference will only be made in the following description to a top display and a bottom display for displaying the data to be consulted or edited.

By activating one of sensors C4 or C5, it is possible to display, in ascending order, all the menus of the diary function. At each successive activation of one of sensors C4 or C5 by a user's finger, the Notes 102, Addresses 103, Diary 104, Transmission 105 and Settings 107 menus are displayed on the liquid crystal displays following Asulab menu 101. These different menus can also be displayed on said displays in descending order by successively activating one of sensors C6, C7 as indicated by the direction of the arrows in FIG. 3.

When one of menus 102, 103, 104, 105 and 106 is displayed on said displays, it is possible to select the displayed menu by activating validation sensor C1. This allows data stored in the selected menu 107 to 111 to be consulted, or new data to be edited in the selected menu.

Since the diary watch includes short distance radio frequency signal transmitting and/or receiving means, when Transmission menu 105 is shown, activating sensor C1 causes a selection 110 of the Transmission menu. From this moment, the sensors become inactive until the transmission of the diary data, to be communicated to a computer station or to another watch, has succeeded or failed. It is also possible to provide entering to this Transmission menu by activating validation sensor C1 for a determined period of time.

Once a menu selection has been made by sensor C1, it is still possible to return to the initial display position of the Asulab menu by activating push-button 9. Moreover, if there has been no operation of the diary function, the microprocessor unit controls the diary function to be automatically stopped after a determined period of inactivity. Stopping the diary function makes the sensors inactive and normally no information is displayed by the liquid crystal displays.

Figure 4:
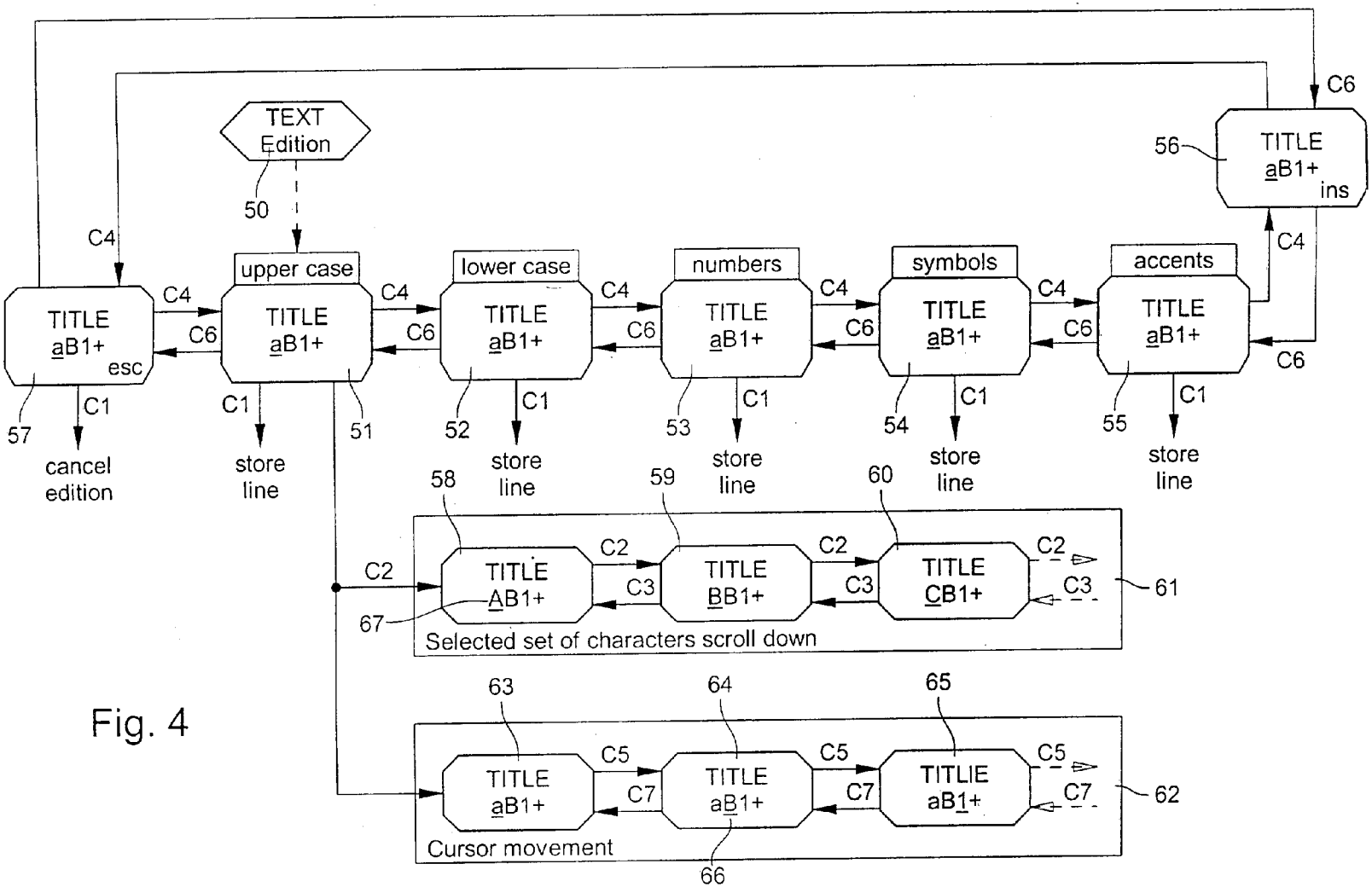
FIG. 4 shows a flow chart of different steps of the method for editing a text using touch sensitive pads of the watch.

FIG. 4 shows steps for editing or modifying a text 50 of the control method according to the invention.

In the Notes, Addresses, Diary and Settings menus selected, it is possible to write or modify texts. In order to do this, it is necessary to activate validation sensor C1 for a determined period of time, for example for 2 seconds, in order to enter this text-editing mode. In FIGS. 3 to 8, the long activation of sensor C1 is represented by the reference sign C1 long.

The example, shown in FIG. 4 for editing a text, relates to the edition of a title in the selected Notes menu. Of course, the operations described are similar in each other selected menu for editing a text. In the explanation of this Figure, it should be noted that each sensor in this editing mode is configured to execute a different specific function.

In the editing mode activated at first step 51, there is shown on the top display the indication TITLE and on the bottom display a draft text aB1+. According to an initial configuration in the editing mode, the upper case alphanumerical characters are designated by a pointer of the bottom display directed towards an upper case character icon. Moreover, the cursor is positioned on the first character of the message.

Sensors C4 and C6 allow a set of characters (upper case, lower case, numbers, symbols and accents) to be selected in ascending order for sensor C4 and in descending order for sensor C6 as indicated by the direction of the arrows in FIG. 4. As shown in FIG. 4, from upper case alphanumerical characters 51, one passes successively to lower case alphanumerical characters 52, numbers 53, symbols 54 and accents 55 by successively activating sensor C4. After selecting accents 55, the action of sensor C4 selects at least one character insertion position 56. At this step 56, activation of sensor C2 adds spaces for inserting characters. These spaces are each indicated by a cursor bar 66. At this step 56, activation of sensor C3 deletes added spaces, or characters from the title.

From step 56, action on sensor C4 causes one to pass to a cancelling position 57 and finally return to the initial position of upper case characters 51. In the cancelling position, action on validation sensor C1 cancels edition of the text to pass from editing mode to an initial consultation mode.

After each set of character selection, it is possible to store the line of text composed by activating validation sensor C1.

For character choice selection step 61 at the location of cursor indication 66, the selected upper case characters are scrolled in this example via action on sensors C2 and C3. At the beginning of the first brief activation of sensor C2, the first upper case character 67 of the alphabet appears on the bottom display. However, if sensor C3 is briefly activated at the beginning instead of sensor C2, the last upper case letter of the alphabet appears. Action on sensor C2 scrolls the alphanumerical characters chronologically in ascending order, whereas action on sensor C3 scrolls the alphanumerical characters chronologically in descending order. By activating sensor C2 from step 58, one obtains first of all character B at step 59, then character C at step 60. Of course, if sensor C2 is still being activated, the alphabet is run through in ascending order from A to Z. By keeping sensor C2 continually activated, an upper case character scrolling speed can be greater than the character scrolling speed by briefly and successively activating said sensor C2. The same is true of sensor C3 if the latter is activated to scroll the characters of the alphabet in descending order from Z to A.

It should be noted that it is possible to interrupt the scrolling of the characters in ascending order by acting on sensor C2, and to make the characters scroll in descending order by acting on sensor C3, and vice versa, as indicated by the direction of the arrows in FIG. 4.

For the step of moving cursor 66 in the edited or modified text, sensors C5 and C7 are used. At the start, cursor 66 is positioned at the location of the first character to be edited or modified. By activating sensor C5, the cursor moves from step 63 to step 65 towards the right, whereas by activating sensor C7, the cursor moves for example from step 65 to step 63 towards the left as far as the first position.

Once the text has been drafted, validation sensor C1 can be activated to store the edited data and return to the selected menu in consultation mode.

It should be noted that a data field can include, for this preferred mode, up to 63 characters of the alphanumerical type for example, but each display can only show 12 characters. The drafted message will thus scroll on the display allowing it to be read in its entirety.

Figure 5:
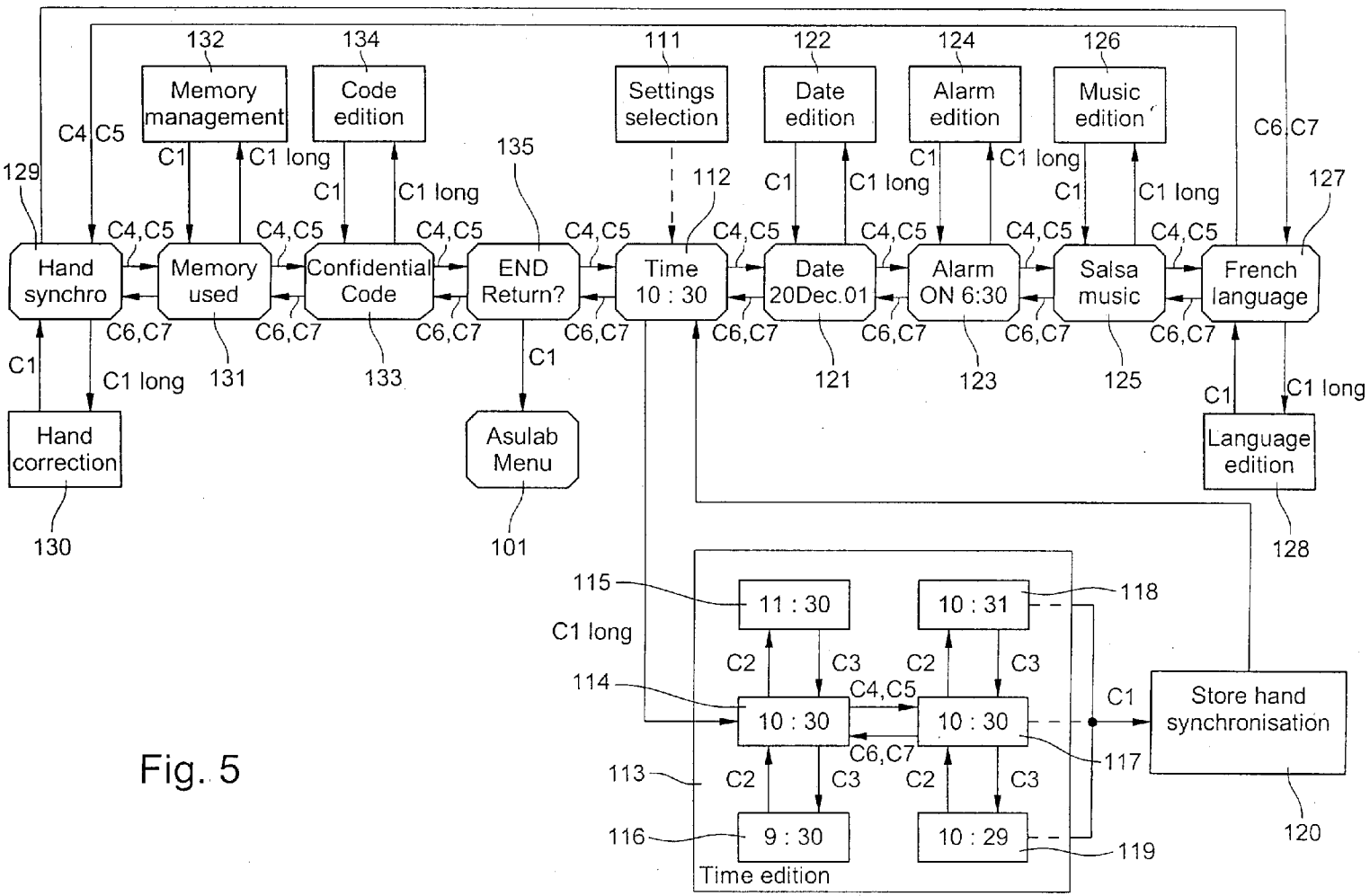
FIG. 5 shows a flow chart of steps of the method, according to the invention, for displaying or entering, modifying or deleting parameters of the diary watch.

FIG. 5 shows various steps of the control method, according to the invention, for consulting or entering data and/or parameters in the selected menu Settings 111.

Once the Settings menu 111 has been selected, the liquid crystal displays first of all indicate the current time at step 112 which originates for example from a time-keeping circuit of the watch corresponding to the time displayed by the hands. In this mode for consulting various data or parameters of the menu, one of the sensors of a first group of sensors C4, C5 can be activated to consult various data or parameters in ascending order or in a determined direction. One of the sensors of a second group of sensors C6, C7 can be activated to consult said data or said parameters in descending order or in an opposite direction. Activation of sensors C2 and C3 has no effect in this Settings menu-consulting mode.

By successively activating one of sensors C4 or C5 from the current time indication at step 112, the liquid crystal displays indicate, in chronological order, a current date 121, at least one alarm time 123, musical data 125, a programmed language 127, a hand synchronisation operation 129, an indication of the memory used 131, a confidentiality code 133, and a final return step 135. Of course, by successively activating one of sensors C6 or C7 instead of activating one of sensors C4 or C5, it is possible to consult the data from this menu in an opposite direction. The arrows, connecting each consulting position of this menu, indicate the direction of consultation as a function of the sensors activated C4, C5 or C6, C7. Passage to these different steps can also be achieved by keeping one of sensors C4 or C5 or one of sensors C6 or C7 activated.

By way of an example of editing or setting parameters, the way in which the displayed time is corrected will be explained hereinafter. By activating sensor C1 for a determined period of time at step 112, one passes into a time editing or setting mode 113. At step 114, the bottom display indicates the time 10:30 to be corrected with the first hour indicating figures flashing. If sensor C2 is activated briefly from step 114, the hour figures are incremented by one unit to indicate 11:30 at step 115. Conversely, if sensor C3 is briefly activated at step 114, the hour figures are decremented by one unit to indicate 9:30 at step 116. Of course, it is also possible to pass from step 116 to step 114 by briefly activating sensor C2 to increment the hour figures by one unit or to pass from step 115 to step 114 by briefly activating sensor C3 to decrement the hour figures by one unit.

If sensor C2 is briefly activated several times, the hour figures are incremented by the number of units corresponding to the number of activations of sensor C2. Said sensor C2 can also be kept activated to scroll the hour figures in ascending order at a determined speed so as to correct the hour between 0 and 12 o'clock or between 0 and 24 hours depending on the desired configuration. Likewise, if sensor C3 is briefly activated several times, the hour figures are decremented by the number of units corresponding to the number of activations of sensor C3. Sensor C3 can, like sensor C2, be kept activated to scroll the hour figures in descending order at a determined speed.

In order to correct the minutes of the time displayed at step 114, one of sensors C4 or C5 has to be activated so as to cause the flashing minute figures to appear on the bottom display at step 117. The reverse operation can also be achieved by activating one of sensors C6 or C7 to pass from step 117 to step 114. As previously, by briefly activating sensor C2 at step 117, the minute figures are incremented by one unit to indicate 10:31 at step 118. Conversely, by briefly activating sensor C3 at step 117, the minute figures are decremented by one unit to indicate 10:29 at step 119. Of course, it is also possible to pass from step 119 to step 117 by briefly activating sensor C2 to increment the minute figures by one unit or to pass from step 118 to step 117 by briefly activating sensor C3 to decrement the minute figures by one unit.

If sensor C2 is briefly activated several times particularly from step 117, the minute figures are incremented by the number of units corresponding to the number of activations of sensor C2. Said sensor C2 can also be kept activated to cause the minute figures to scroll in ascending order at a determined speed in order to correct the minutes between 0 and 59 minutes. Likewise, if sensor C3 is briefly activated several times particularly from step 117, the minute figures are decremented by the number of units corresponding to the number of activations of sensor C3. Sensor C3 can, like sensor C2, be kept activated to cause the minute figures to scroll in descending order at a determined speed.

Once the watch time has been corrected, the time is stored and the hands of the watch movement are synchronised at step 120 by activating validation sensor C1. From step 120 one returns to current time indication step 112.

The date at step 121 can also be modified. By activating validation sensor C1 for a determined period of time, one enters date editing mode at step 122. Not all of the date correction or modification steps will be described in detail, but they are based on the same principle described previously for correcting the displayed time. After having corrected the date, validation sensor C1 can be activated to stored the corrected date and return to step 121.

At least one alarm time at step 123 can also be programmed. By activating validation sensor C1 for a determined period of time, one enters an alarm function-editing mode at step 124. The setting or programming of this alarm time will not be described in detail here either, since this setting is based on the same principle of activating sensors C2 to C7 described previously for correcting the displayed time. Validation of the programmed alarm time is achieved by activating sensor C1.

At step 125, activating sensor C1 for a determined period of time causes one to pass to step 126 to the desired music setting mode for example for at least one alarm or to indicate meetings or appointments. In this setting mode, activating sensor C2 or C3 allows a melody to be selected. Several melodies to be selected, for example four, are stored in the microprocessor unit. They are each designated by a title appearing on the bottom display during selection at step 126 or after storage following activation of sensor C1.

At step 127, activating sensor C1 for a determined period of time allows one to enter the desired language setting mode at step 128 to designate for example each object of the records in a desired language. In this setting mode, activating sensor C2 or C3 allows a language to be selected. Several languages to be selected, for example at least five languages, are stored in the microprocessor unit. They are each indicated on the bottom display during selection at step 128 or after storage following activation of sensor C1.

At step 129, activating sensor C1 for a determined period of time allows one to enter a hand position setting mode at step 130. The hands are set by activating for example one of sensors C2 or C3 which have the task of moving the hands to a reference position, such as 12 o'clock indicated on the bottom display. Activating sensor C2 allows the minute hand to be moved in the clockwise direction, whereas activating sensor C3 allows the minute hand to be moved in the anti-clockwise direction. Once the hands have been returned to the reference position by manual action on sensors C2 and C3, activation of sensor C1 will allow the hands to be returned to their corrected time indicating position. Activating sensor C4 or C5, or sensor C6 or C7 allows the hours to be corrected. At each activation, an hour is corrected in the clockwise direction with one of sensors C4 or C5 or in the anti-clockwise direction with one of sensors C6 or C7.

At step 131, activating sensor C1 for a determined period of time allows the memory place to be automatically managed at step 132 which includes a certain number of stored records. Once management is completed, one returns to step 131.

At step 133, activating sensor C1 for a determined period of time allows one to pass into a confidential code-editing mode at step 134. In this editing mode, it is possible to write a code name as explained with reference to FIG. 4. At the end of the code entered at step 134, activating sensor C1 will store the confidential code and cause one to pass to step 133.

Finally, activating sensor C1 at step 135 causes a return to initial position 101 of the diary function.

Figure 6:
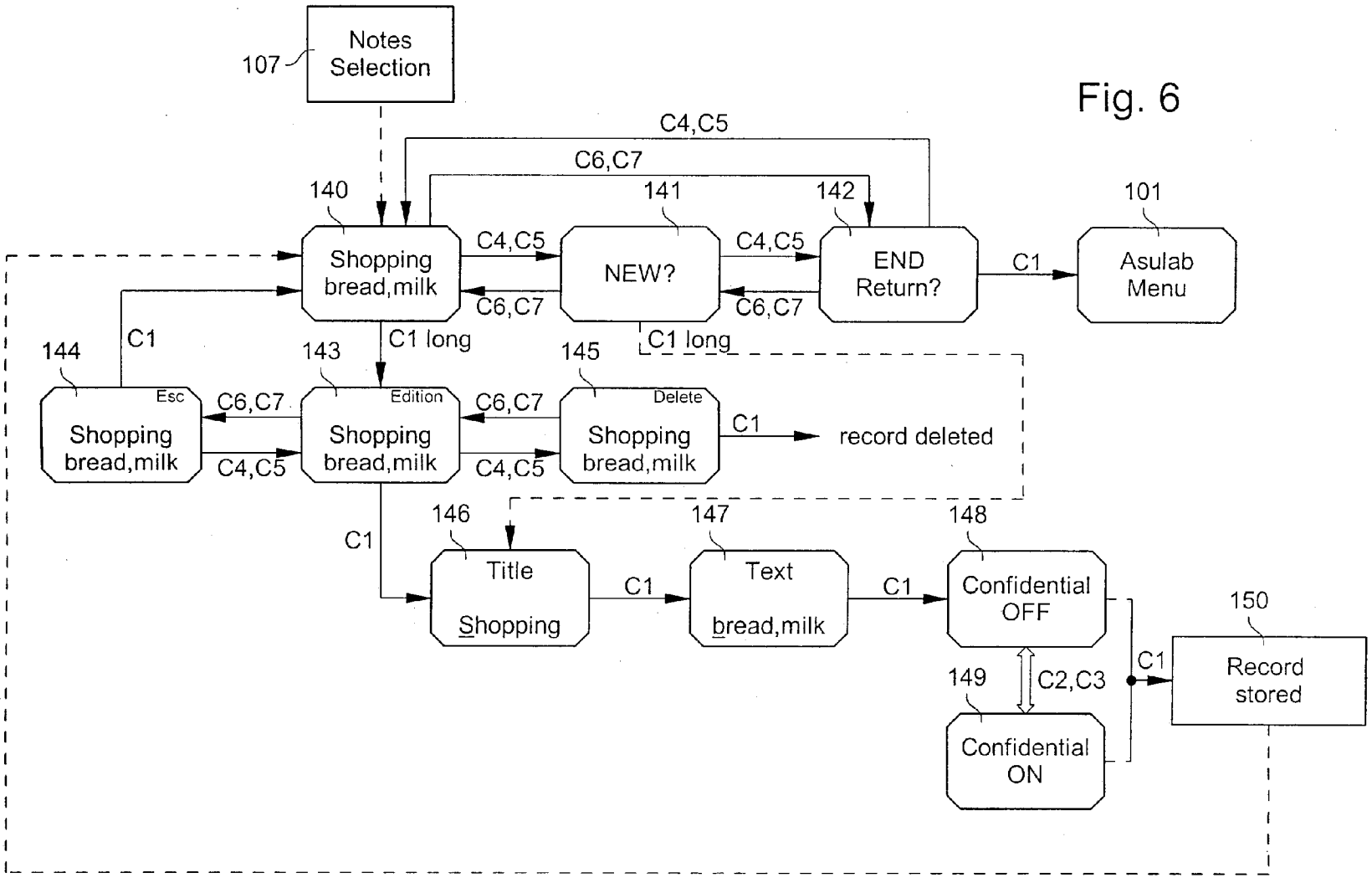
FIG. 6 shows a flow chart of steps of the method, according to the invention, for displaying or entering, modifying or deleting data in the selected note menu.

FIG. 6 shows different steps of the control method according to the invention, for consulting, entering, modifying or deleting data in the selected Notes menu 107.

Once Notes menu 107 has been selected, the first note already stored appears on the liquid crystal displays at step 140. The title of the drafted note is displayed on the top display, whereas the text of the drafted note is displayed on the bottom display. All the notes already stored can be consulted in chronological order by activating one of sensors C4 or C5. Activating one of sensors C6 or C7 allows these stored notes to be consulted in reverse order. Of course, if no notes have been drafted previously, the selection of Notes menu 107 will lead directly to the step 141 indication.

By activating one of sensors C4 or C5 from step 140, one passes to step 141. At this step, it is possible to order execution of a new note by activating sensor C1 for a determined period of time. The title of the note, which appears on the top display, has to be drafted first of all and then, after activation of sensor C1, the text of the note, which appears on the bottom display after storage of the note.

By activating one of sensors C4 or C5, it is possible to pass from step 141 to final step 142. In this final step 142, action on sensor C1 causes a return to initial position 101 of the diary function. Finally, from step 142, action on one of sensors C4 or C5 causes one to pass to step 140 of the first note stored.

The note stored at step 140 can be modified. By activating sensor C1 for a determined period of time, one passes to step 143, of a note editing or modifying mode. By activating one of sensors C4 or C5 from step 143, one passes to step 145. At this step 145, action on sensor C1 causes deletion of the stored note and a return to a new first consultation position in the Notes menu. From this step 145, return to step 143 can be achieved by activating one of sensors C6 or C7. Another action on one of sensors C6 or C7 causes one to pass from step 143 to step 144 which is an escape position. At this step 144, action on sensor C1 will cause return to the initial position of step 140 without modifying the note. From step 144, return to step 143 can be achieved by activating one of sensors C4 or C5.

By choosing to modify the previously stored note, sensor C1 has to be activated at step 143. From this moment at step 146, the cursor is placed under the first character of the title of the note. Modification of the title can be achieved as explained hereinbefore with reference to FIG. 4.

Once the title has been modified, action on sensor C1 causes one to pass to step 147 to modify the text of the note. As previously, the cursor is placed under the first character of the text of the note. Modification of the text can be achieved as explained hereinbefore with reference to FIG. 4.

After having modified the text of the note at step 147, action on sensor C1 causes one to pass to step 148 or 149 to select the confidentiality of the drafted note. By acting on sensor C2 or C3, one can choose whether the note should be confidential or not. Finally, after this step, sensor C1 can be activated to store the modified note at step 150 with a return to initial step 140.

Figure 7:
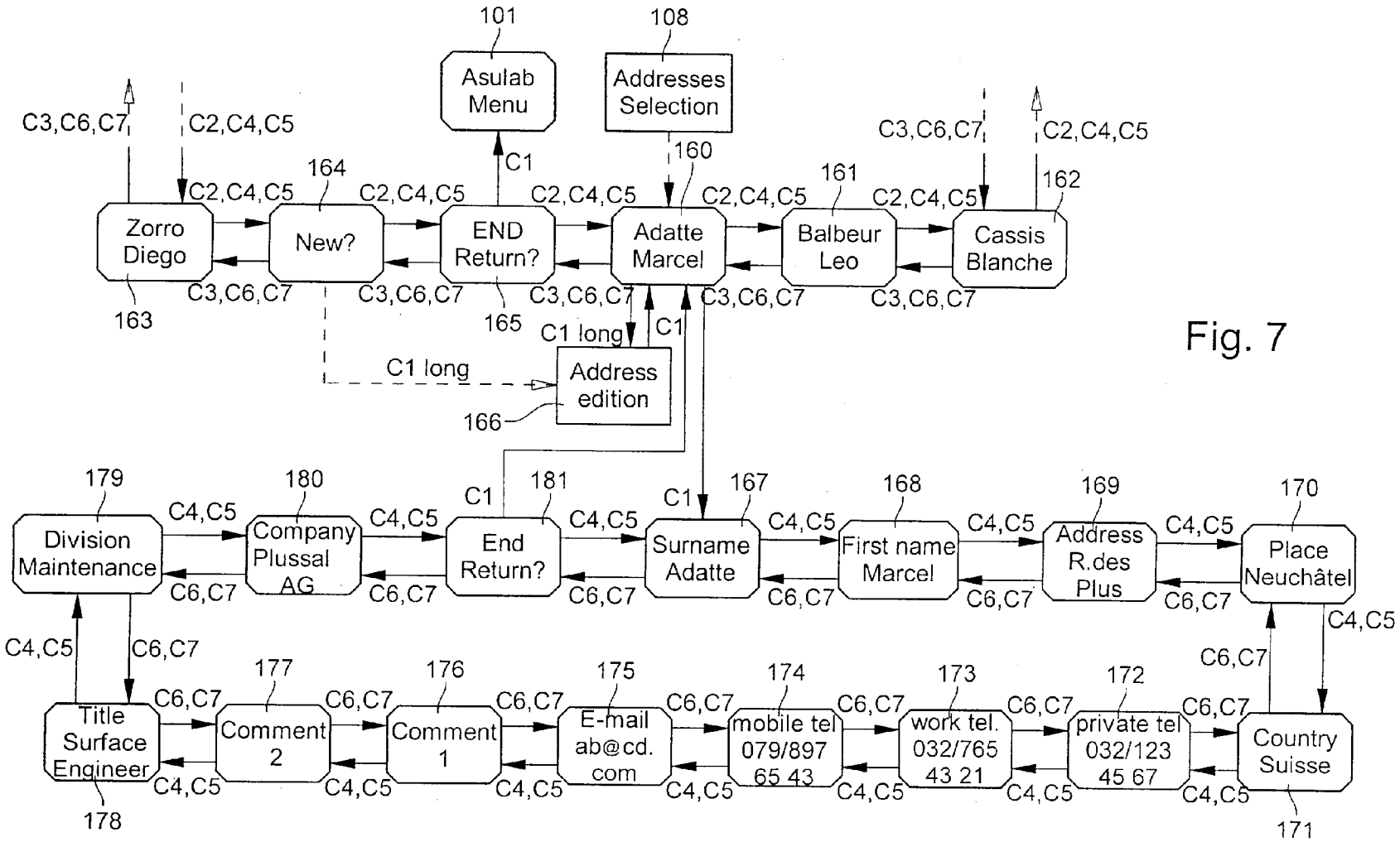
FIG. 7 shows a flow chart of steps of the method, according to the invention, for displaying or entering, modifying or deleting data in the selected address menu.

FIG. 7 shows different steps in the control method according to the invention, for consulting, entering, modifying or deleting data in the selected Addresses menu 108.

Once Addresses menu 108 has been selected, the surnames and first names at step 160 of the first address stored are displayed on the liquid crystal displays. The address book is managed and stored by alphabetical order in the microprocessor unit. All of the address records already stored in the address book can be consulted individually.

By activating one of sensors C2, C4 or C5, one can consult the address book from step 160 to step 163 in alphabetical order from A to Z of the surnames and first names already stored. By activating one of sensors C3, C6 or C7, one goes through the address book in an opposite order from Z to A.

If several address record surnames begin with the same letter of the alphabet, action on sensor C2, or respectively sensor C3, causes one to pass directly from that letter of the alphabet to the next, or respectively preceding letter. Conversely, action on sensors C4 to C7 allows one to run through all the surnames of the same letter of the alphabet in ascending order with sensors C4 and C5 or in descending order with sensors C6 and C7.

From step 163 of the last stored address, one passes to step 164 by activating one of sensors C2, C4 or C5. At step 164, it is possible to enter an address-editing mode at step 166 by activating sensor C1 for a determined period of time so as to enter all the data of a new address to be stored. Return from step 164 to step 163 can be achieved by activating one of sensors C3, C6 or C7.

By activating one of sensors C2, C4 or C5 from step 164, or by activating one of sensors C3, C6 or C7 from step 160, one passes to the final step 165 from which it is possible to return to initial position 101 of the diary function via action on sensor C1.

In order to consult all the stored data of a particular address for example for the first address of step 160, sensor C1 is briefly activated to pass to step 167. However, by activating sensor C1 for longer, for a determined period of time, one enters an address editing mode where modifications can be made to previously stored address data. As regards the way in which all the data of a new address or an address to be modified is entered, explanations have already been given with reference to FIG. 4. However, after each edited or modified address field, it is necessary to activate sensor C1 to pass to the next field. After the last edited or modified field, activation of sensor C1 causes all the data to be stored and a return to the initial position for example at step 160.

From step 167, all the stored data fields can be consulted by activating one of sensors C4 or C5 to display this step 167 data at step 180 in ascending order. These data fields can also be consulted in descending order for example from step 180 to step 167 by activating one of sensors C6 or C7. The different fields of each address record are relative to the surname 167, first name 168, street 169, city 170, country 171, for example to three types of telephone numbers 172 to 174, to an email address 175, comments 176 and 177, the person's title 178, profession 179 and the company 180.

By activating one of sensors C4 or C5 at step 180 or by activating one of sensors C6 or C7 at step 167, one passes to a final step 181. By activating sensor C1 at this final step 181, one returns to initial position 160.

Figure 8:
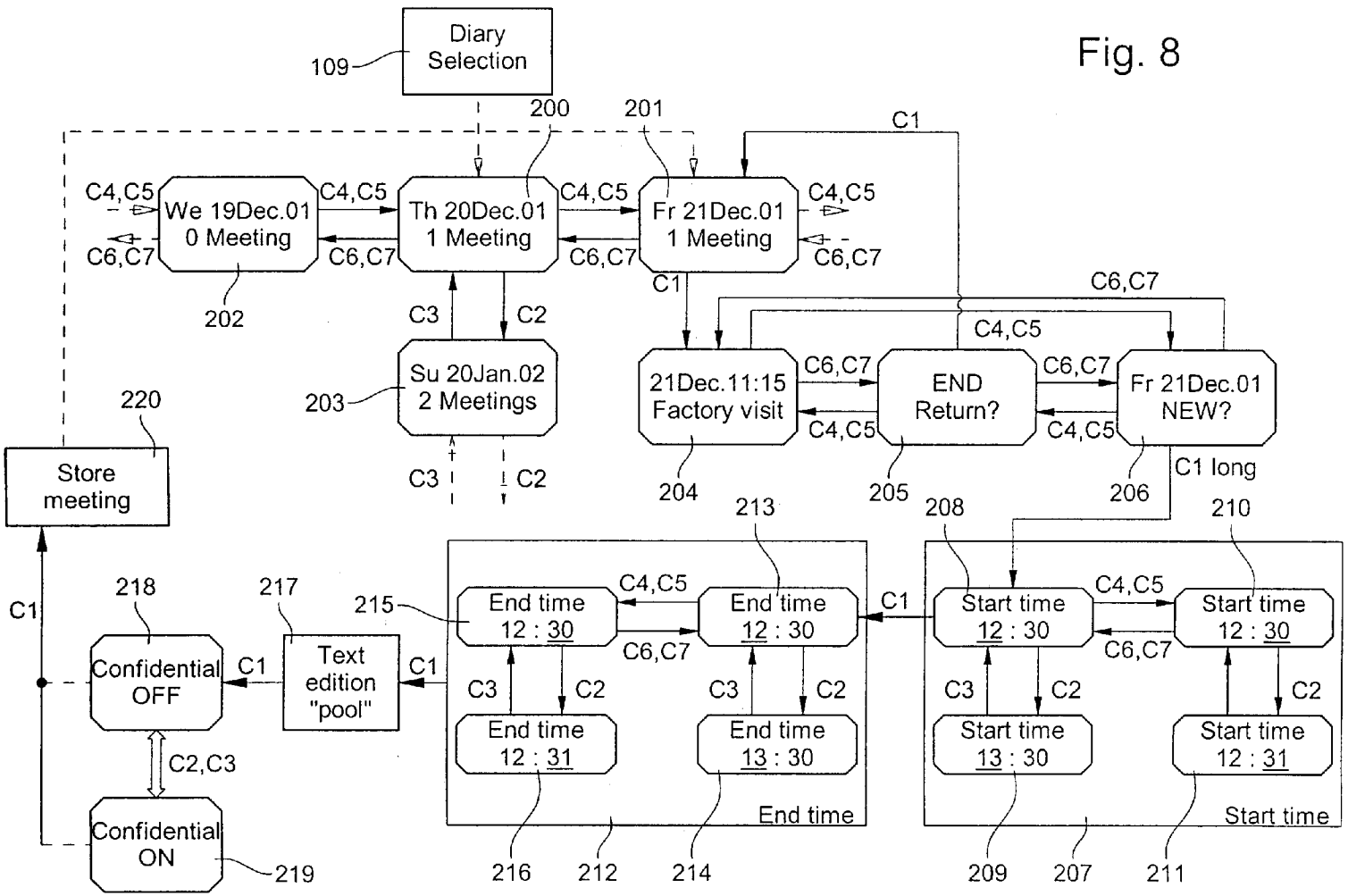
FIG. 8 shows a flow chart of steps of the method, according to the invention, for displaying or editing, modifying or deleting data in the selected diary menu.

FIG. 8 shows different steps of the control method according to the invention, for consulting, entering, modifying or deleting data in the selected Diary menu 109. In this menu, several meetings or appointments can be stored in accordance with a calendar defining the day, the month and the year. So as to provide a reminder of stored meetings or appointments, the user of the watch may be provided with an acoustic signal, for example using one of the melodies programmed in the Settings menu. Indication of the meeting can be provided in a different manner using a light signal or using vibrations of the watchcase.

Once the Diary menu 109 has been selected, one passes to step 200 indicating on the top display the indication of the current day and, on the bottom display, the number of meetings already stored at this step 200. By briefly activating one of sensors C4, C5 at step 200, one passes to the next day at step 201. By activating one of sensors C4, C5 many times or by keeping it activated, the days scroll in ascending order at a determined speed. However, by activating or keeping activated one of sensors C6, C7, the days scroll in descending order at a determined speed. In order to pass from step 200 to step 202, one of sensors C6 or C7 has to be briefly activated once.

In order to change the days in ascending or respectively descending order, sensor C2 or respectively sensor C3 has to be activated. For example in order to pass from step 200 to step 203 corresponding to a following month, sensor C2 has to be briefly activated. In order to pass from step 203 to step 200, sensor C3 has to be briefly activated.

By being positioned on a particular day, it is possible to consult the previously stored meetings and appointments. For example by briefly activating sensor C1 at step 201, one passes to step 204 indicating the first stored meeting. Several meetings can be consulted from this step 204 in ascending order by activating one of sensors C4 or C5 or in descending order by activating one of sensors C6 or C7. In this example, a single meeting has been stored.

By activating one of sensors C6 or C7 at step 204, one passes to final step 205, from which it is possible to return to initial step 201 by activating sensor C1. By activating one of sensors C4 or C5 at step 204, one passes to step 206 proposing a new meeting entry.

By activating sensor C1 for a determined period of time at step 206, one enters a new meeting-editing mode in which the start time of the meeting has to be programmed at step 207 in a first field. A predefined time may appear on the bottom display at step 208. As explained with reference to FIG. 5, programming the hour can be achieved using sensors C2 to C7. By activating sensor C2 at step 208, the hour figures are incremented by one unit to pass to step 209. The reverse operation is accomplished by activating sensor C3. By activating one of sensors C4 or C5 at step 208, one passes to step 210 for programming the minutes. Thus, by activating sensor C2 at step 210, the minutes figures are incremented by one unit to pass to step 211. The reverse operation is accomplished at step 211 by activating sensor C3.

Once the start time is selected, sensor C1 is activated to pass to the end of meeting time programming at step 212 in a second field of the diary record. As previously described, a predefined time may appear on the bottom display at step 213. This predefined time correspond normally to the start time which was stored. By activating sensor C2 at step 213, the hour figures are incremented by one unit to pass to step 214. The reverse operation is accomplished by activating sensor C3. By activating one of sensors C4 or C5 at step 213, one passes to step 215 for programming the minutes. Thus, by activating sensor C2 at step 215, the minutes figures are incremented by one unit to pass to step 216. The reverse operation is accomplished at step 216 by activating sensor C3.

After having fixed the end of meeting time, sensor C1 can be activated to pass to step 217 to draft a meeting information text in at least a third field of the diary record. The same operations for drafting a text were described hereinbefore with reference to FIG. 4.

After having drafted a text, sensor C1 is activated in order to select the confidentiality of the meeting at steps 218 and 219. By acting on sensor C2 or C3, one can choose whether the note should be confidential or not. After this step of activating sensor C1, one can store the meeting at step 220 and return to initial position 201.

From the description that has just been given, multiple variants of the control method for executing functions in an electronic watch can be envisaged by those skilled in the art without departing from the scope of the invention defined by the claims.

What is claimed is:

1. A control method for executing functions in an electronic diary watch, including, in a case closed by a crystal, a time-keeping circuit and/or a watch movement powered by an energy source, a dial on which the time is displayed in a digital and/or analogue manner, at least one liquid crystal display for displaying diary data, a determined number of sensors, one touch sensitive pad of each sensor being arranged on an internal or external face of the crystal, each sensor being able to be activated by a user's finger placed on the crystal in a determined zone of the sensitive pad of the sensor to be activated, and a microprocessor unit programmed to manage the diary function operations so as to consult different menus or stored data, or to enter, modify or delete data and/or parameters by means of the sensors connected to the microprocessor unit, wherein the method includes, in a first diary function consulting mode in which at least one group of sensors is configured by the microprocessor unit so that each activated sensor of said group of sensors is able to carry out a same function, a first series of steps of:

displaying different menus or parameters or data or data records of the diary function menu on the liquid crystal display in ascending or descending order by activating at least one sensor of said group of sensors, and selecting a menu or data record, of a type from among several types, of the menu to be consulted by activating a validation sensor, and wherein the method includes, in a second data and/or parameters entry, modification or deletion mode in which each sensor is configured by the microprocessor unit so that each activated sensor is able to control execution of a different specific determined function, a second series of steps of:

activating the validation sensor for a determined period of time or with a determined application of pressure in order to enter the second mode in a desired position of a selected menu, and entering, modifying or deleting data and/or parameters by activating certain sensors, and validating the parameters and/or the data entered, modified or deleted by action on the validation sensor.

2. The method according to claim 1, wherein in order to carry out the first and second series of steps of the method for the diary function, a determined number of sensors, selected between three and ten, and preferably equal to seven, is used.

3. The method according to claim 1, wherein during the first series of steps of the method, two groups of sensors are used each formed of a pair of sensors, to display, in ascending order, the different menus or data or data records by activating at least one sensor of the first group, or to display, in descending order, the different menus or data or data records by activating at least a sensor of the second group.

4. The method according to claim 1, wherein after the menu or data record selection step in the first series of steps of the method, stored record data fields of the menu selected are consulted in ascending or descending order by activating at least one sensor of a first group of sensors.

5. The method according to claim 4, wherein by selecting a menu from among the notes, addresses, diary, transmission or settings menus, second and third sensors are used, that are different from the sensors of the first and second groups for consulting different record fields of the selected menus in ascending or descending order.

6. The method according to claim 1, wherein in order to select a menu or validate data or parameters in the first and second series of steps of the method, a validation sensor is used whose sensitive pad is arranged at the centre of the crystal, whereas the sensitive pads of the other sensors, used for consulting menus or data or data records, or for entering, modifying or deleting data and/or parameters of the first and second series of steps of the method are distributed at the periphery of the crystal around the sensitive pad of the validation sensor while being sufficiently separated from each other so that a single sensor can be activated by a user's finger without influencing the neighbouring sensors, and so that the menus or data displayed on one or two liquid crystal displays is made visible when the sensors are activated.

7. The method according to claim 6, wherein in the second series of steps of the method, a data field of a selected menu record, selected from among notes, addresses or diary menus, is edited by the steps of:

selecting a set of characters among several sets in an ascending or descending order by activating one of the sensors located above the 3 o'clock and 9 o'clock indications of an analogue watch;

running through the alphanumerical characters, numbers, symbols or accents depending on the set of characters selected, to complete a space of a field to be edited, in ascending or descending order by activating one of the sensors located at the periphery of the crystal in the 6 o'clock and 12 o'clock indicating positions of an analogue watch;

moving a cursor, defining the space of a character to be sought, modified or deleted, in the edited field in one direction or the other by activating one of the sensors located below the 3 o'clock and 9 o'clock indications of an analogue watch, and repeating the above steps and validating the edited field to be stored by activating the validation sensor.

8. The method according to claim 7, wherein at a character searching step in a selected set of characters in a data field editing mode, the speed at which the characters scroll in ascending or descending order is dependent on the duration of activation of one of the sensors located in the 6 o'clock and 12 o'clock indicating positions of an analogue watch, below a determined activation duration the characters scrolling at a first slow speed and above a determined activation duration the characters scrolling at a second high speed.

9. The method according to claim 1, wherein before beginning the first series of steps, the watch diary function is switched on when switch-on means are activated, the sensors and the liquid crystal display being placed previously and/or after a period of inactivity of the diary function, in a standby mode.

10. The method according to claim 9 for a diary watch with two hands driven by the watch movement to display the time in an analogue manner, wherein at the moment when the diary function is switched on by the switch-on means, the time indicating hands are moved into determined positions to avoid concealing the data displayed on one or two liquid crystal displays and/or to avoid disturbing the operation of the sensors.

11. The method according to claim 1 for a diary watch with short distance radio-frequency signal receiving and/or transmitting means for communicating with a computer station and/or another electronic watch, wherein once the transmission menu has been selected in the first series of steps by the validation sensor, all the edited and/or stored fields are transmitted by the receiving and/or transmitting means once a connection is established between the computer station and/or the other watch.

12. The method according to claim 1 for a diary watch with two liquid crystal displays, wherein in the first and second series of steps, at least one pointer on at least one of the liquid crystal displays appears to designate at least one icon of a group of icons arranged on the dial in determined positions around each liquid crystal display so as to indicate a function or an operation in progress.

13. The method according to claim 1, wherein markings are used placed on the inner face of the watch crystal in order to indicate the location of each sensor sensitive pad and/or a function of each sensor so as to facilitate the activation of the sensors for consulting the menus or data or data records, and the entry, modification or deletion of the data and/or parameters.

14. A control method for executing functions in an electronic diary watch, which includes in a case closed by a crystal, a time-keeping circuit and/or a watch movement powered by an energy source, a dial on which the time is displayed in a digital and/or analogue manner, at least one liquid crystal display for displaying diary data on one or more lines, a determined number of sensors, one touch sensitive pad of each sensor being arranged on an internal or external face of the crystal, each sensor being able to be activated by a user's finger placed on the crystal in a determined zone of the sensitive pad of the sensor to be activated, and a microprocessor unit programmed to manage the diary function operations so as to consult different menus or stored data, or to enter, modify or delete data and/or parameters by means of the sensors connected to the unit, said microprocessor unit being able to configure in a first diary function consulting mode at least one group of sensors, so that each activated sensor of said group of sensors is able to carry out a same function, or to configure separately each sensor in a second data and/or parameters entry, modification or deletion mode so that each activated sensor is able to control execution of a different specific determined function, wherein the method includes a first series of steps, in a data and/or parameter entry, modifying or deletion mode, of:

activating a validation sensor for a determined period of time or with a determined application of pressure in order to enter the data and/or parameter entry, modifying or deletion mode in a desired position of a selected menu;

entering, modifying or deleting data and/or parameters by activating certain sensors, each activated sensor controlling execution of a different specific determined function in this mode, and validating the parameters and/or the data entered, modified or deleted by action on the validation sensor.

15. The method according to claim 14, wherein it includes a series of preliminary steps of:

switching on the diary function when switch-on means are activated, the sensors and one or two liquid crystal displays being placed beforehand and/or after a period of inactivity of the diary function in a standby mode;

displaying in a consultation mode different menus or data or data records of the diary function on at least one liquid crystal display in ascending or descending order by activating at least one sensor of a group of sensors each able to carry out a same function in this consultation mode, and selecting a menu or data record, of a type from among several types, of the menu to be consulted by activating the validation sensor, and consulting stored data fields of selected menu records in ascending or descending order by activating at least one sensor of the group of sensors.

16. The method according to claim 14, wherein markings are used placed on the inner face of the watch crystal in order to indicate the location of each sensor sensitive pad and/or a function of each sensor so as to facilitate the activation of the sensors for consulting the menus or data or data records, and the entry, modification or deletion of the data and/or parameters.

* * * * *